US008851753B1

(12) United States Patent
Belser

(10) Patent No.: US 8,851,753 B1
(45) Date of Patent: Oct. 7, 2014

(54) ENCLOSURE LINER

(76) Inventor: Marshell D. Belser, Cincinnati, OH (US)

( * ) Notice: Subject to any disclaimer, the term of this patent is extended or adjusted under 35 U.S.C. 154(b) by 263 days.

(21) Appl. No.: 13/251,279

(22) Filed: Oct. 2, 2011

Related U.S. Application Data

(60) Provisional application No. 61/389,299, filed on Oct. 4, 2010.

(51) Int. Cl.

| | |
|---|---|
| ***B65D 33/14*** | (2006.01) |
| ***B65D 30/22*** | (2006.01) |
| ***B65D 33/00*** | (2006.01) |
| ***B65D 85/18*** | (2006.01) |
| ***B65D 85/20*** | (2006.01) |

(52) U.S. Cl.
USPC ..... 383/22; 383/11; 383/40; 383/97; 206/278; 206/315.1; 206/806; 206/818; 211/118

(58) Field of Classification Search
CPC ..... A47B 43/00; A47B 43/003; A45C 13/03
USPC ..... 383/97, 24, 22, 33, 38, 39, 11, 40; 312/3, 6, 4, 5; 211/85.3, 38, 113, 118; 206/315.1, 818, 806, 278, 278.1, 298; 248/95, 99; 220/495.06, 495.08
See application file for complete search history.

(56) References Cited

U.S. PATENT DOCUMENTS

| | | | | | |
|---|---|---|---|---|---|
| 1,805,877 | A | * | 5/1931 | Lichtig | 206/213 |
| 1,847,066 | A | * | 3/1932 | Berg | 312/6 |
| 2,016,520 | A | * | 10/1935 | Short | 206/289 |
| 2,039,823 | A | * | 5/1936 | Miller | 312/259 |
| 2,440,192 | A | * | 4/1948 | Cowan | 312/6 |
| 2,517,757 | A | * | 8/1950 | Adlerstein | 312/3 |
| 2,584,722 | A | * | 2/1952 | London | 206/287 |
| 2,845,185 | A | * | 7/1958 | Winderweedle, Jr. | 108/164 |
| 3,184,273 | A | * | 5/1965 | Blough | 312/6 |
| 3,365,684 | A | | 1/1968 | Stemke | |
| 3,598,297 | A | * | 8/1971 | Welch | 224/558 |
| 3,669,276 | A | * | 6/1972 | Woods | 211/34 |
| 4,098,376 | A | | 7/1978 | Pelavin | |
| 4,118,087 | A | * | 10/1978 | Dorf | 312/291 |
| 4,248,364 | A | * | 2/1981 | Anderson | 383/6 |
| 4,382,640 | A | * | 5/1983 | Kashden | 312/5 |
| 4,461,402 | A | | 7/1984 | Fell | |
| 4,491,217 | A | | 1/1985 | Weder | |
| 4,537,451 | A | * | 8/1985 | Bredderman et al. | 312/6 |
| 5,181,625 | A | | 1/1993 | Podd | |
| 5,713,502 | A | * | 2/1998 | Dixon | 224/542 |
| 5,713,646 | A | * | 2/1998 | Wang | 312/3 |

(Continued)

*Primary Examiner* — Jes F Pascua
(74) *Attorney, Agent, or Firm* — William B. Richards, Esq.; The Richards Law Firm LLC

(57) ABSTRACT

An enclosure liner is provided which includes a bag, which bag has a top panel, two side panels, a back panel, and a bottom panel. The front panel forms an access to enable items to be placed within, and withdrawn from, the interior of the liner, and a closure, such as a zipper, is attached to the periphery of the access to enable the liner to be sealed shut. Pockets to accommodate the hooks often found in conventional lockers are strategically placed and are sized to allow clothes and other items to be hung from the pocket-covered hooks. A plurality of magnets suspend the liner within the enclosure and a pad forms a floor suitable for storing shoes and other like articles.

7 Claims, 5 Drawing Sheets

(56) References Cited

U.S. PATENT DOCUMENTS

| | | | | |
|---|---|---|---|---|
| 5,810,478 | A * | 9/1998 | LaFleur | 383/24 |
| 5,957,310 | A * | 9/1999 | Mitchell | 211/186 |
| 5,992,915 | A | 11/1999 | Thompson | |
| 6,390,573 | B1 * | 5/2002 | Wang | 312/6 |
| 6,505,967 | B1 * | 1/2003 | Alfero-Kuronya | 383/11 |
| 6,543,864 | B2 * | 4/2003 | Cline | 312/3 |
| 6,579,009 | B1 | 6/2003 | Schinasi | |
| 6,609,863 | B1 | 8/2003 | Morioka | |
| 6,719,157 | B2 * | 4/2004 | Stoddart et al. | 211/118 |
| 6,732,659 | B2 * | 5/2004 | Poon | 108/42 |
| 6,814,418 | B2 * | 11/2004 | D'Orso | 312/351 |
| 6,955,273 | B2 | 10/2005 | Hartwall | |
| 6,971,529 | B1 * | 12/2005 | Shapiro | 211/188 |
| 8,579,111 | B2 * | 11/2013 | Elze et al. | 206/315.9 |
| 8,651,353 | B2 * | 2/2014 | Koutouras et al. | 224/653 |
| 2003/0042160 | A1 | 3/2003 | Godshaw | |

* cited by examiner

ENCLOSURE LINER

CROSS-REFERENCES TO RELATED APPLICATIONS

This application claims priority to U.S. Provisional Application No. 61/389,299, filed Oct. 4, 2010, entitled "Locker Liner", which application is incorporated herein by reference.

TECHNICAL FIELD

This description relates to liners for an enclosed space, particularly for a locker or hexahedral-type enclosure.

BACKGROUND

Insect pests have been the bane of human existence throughout history. While, of course, being generally unsightly to many, insect pests also carry germs and disease, and their bites can cause disease and other health problems, including skin rashes and allergy symptoms. Such insect pests include bed bugs (*Cimex lectularius*) and cockroaches (*Periplaneta americana*).

Bed bugs, in particular, can be a problem. In fact, after being largely eradicated as pests in the developed world in the early 1940s, bed bugs are currently enjoying a resurgence and are becoming a common pest in homes, the workplace, and in transient lodging such as hotels and motels. The bed bug is a respecter of neither wealth, hygiene, nor status. One important method of introduction into the home is through the workplace, especially were employees have individual attached lockers in a community locker room. Bed bugs can easily migrate from one locker to another and, once into clothes or personal belongings such as carrying bags, are easily transferred to the home. Once in the home, they migrate to be close to hosts (humans or pets) and commonly in or near beds or furniture. Once introduced, bed bugs are very difficult to manage and so prevention is by far the best approach.

SUMMARY

Various embodiments of the present invention include a liner, which generally conforms to the interior of a locker or other enclosure. The liner comprises a bag, the interior of which is accessible only by an access which is re-sealable, for example, with a zipper, hook-andloop combination (e.g., Velcro®, Velcro USA, Inc., Manchester, N.H.), or other similar closure mechanism. Magnets may be secured in holders attached to the bag, usually at or near the top, for securing the liner to the interior of a metal locker. Alternatively, rods may be attached at or near the top and secure the liner using friction on the inside surfaces of the enclosure. As many lockers have hooks or other features for hanging clothes and other personal belongings inside the locker, the bag may be formed to include pockets which protrude into the interior of the bag to accommodate the hooks and that are sized to allow the hooks to still be used to hang objects such as clothing, purses, or like objects having a carrying strap.

Additional objects, features, and advantages of the invention will become apparent to those skilled in the relevant art upon consideration of the following detailed description of preferred embodiments.

BRIEF DESCRIPTION OF THE SEVERAL VIEWS OF THE DRAWING

The invention will be more readily understood by reference to the accompanying drawings, wherein like reference numerals indicate like elements. The drawings are incorporated in, and constitute a part of, this specification, illustrate several embodiments consistent with the invention and, together with the description, serve to explain the principles of the invention. For purposes of illustration, drawings may not be to scale.

DETAILED DESCRIPTION

Figure 1:
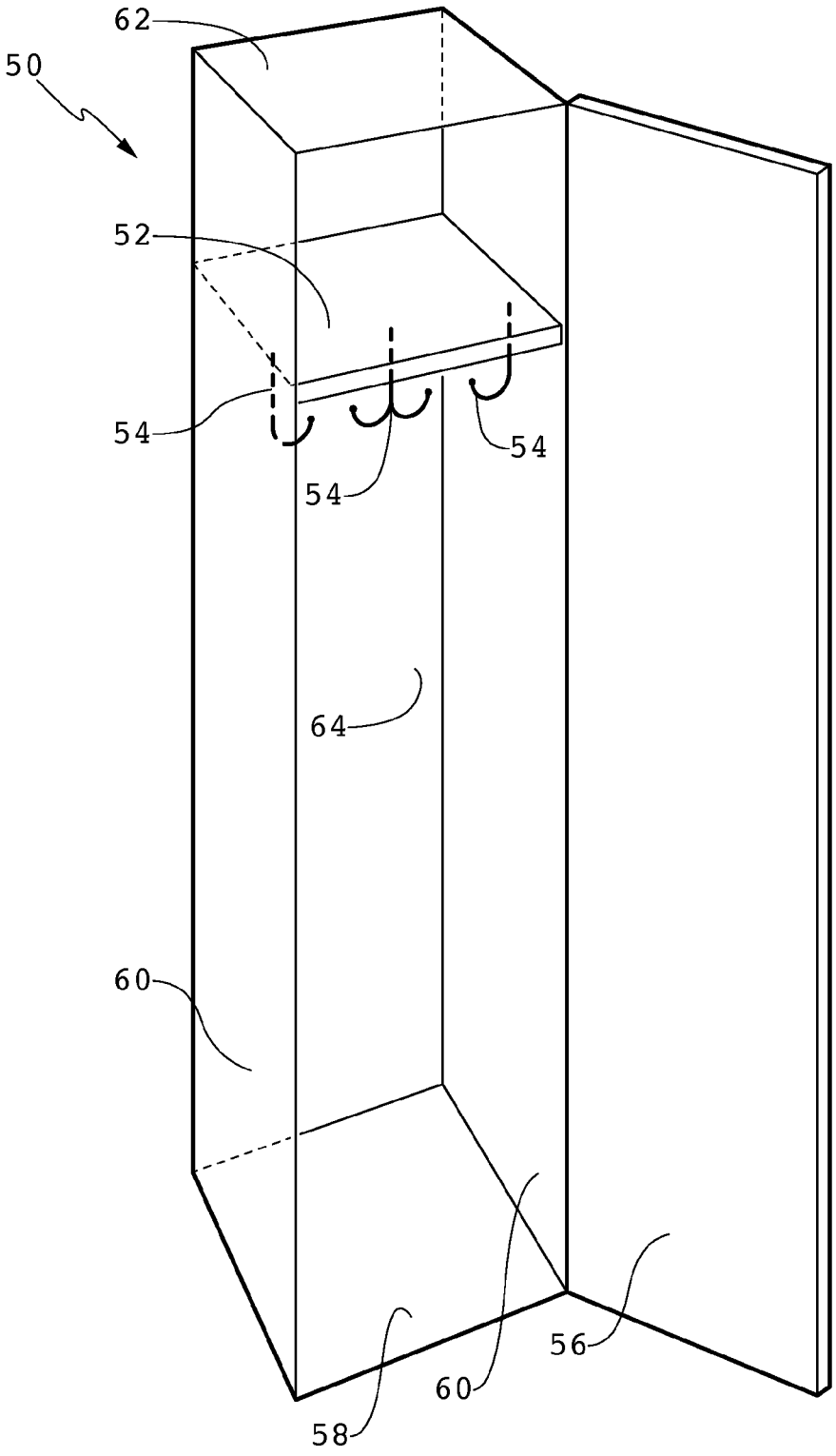
FIG. 1 is a perspective view of a common locker.

A standard locker 50 is shown in FIG. 1. The interior of the locker 50 is generally hexahedral in shape and may include a shelf 52 and hooks or other protuberances 54. The locker 50 includes a top 62, a bottom 58, two sides 60 and a door 56, which cooperate to define the interior of the locker 50. In many configurations, the locker 50 also includes a shelf 52. Most lockers are constructed of metal, but other materials, including wood and plastic, may also be used. Although not shown, most individual lockers are placed adjacent to other lockers with a common side between. And, because the lockers are not sealed, insects and dust can find their way into the interior of an individual locker, especially from adjacent lockers.

Figure 2:
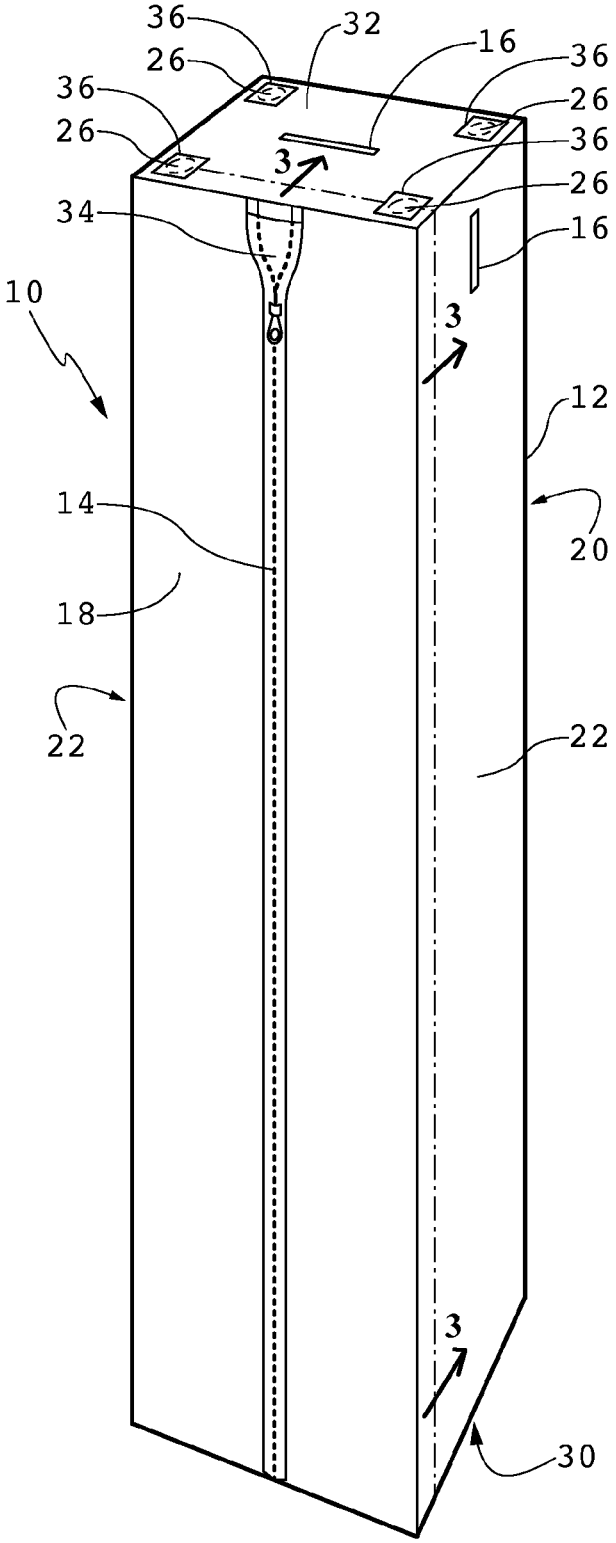
FIG. 2 is a perspective view of an enclosure liner according to an embodiment of the present invention.
Figure 3:
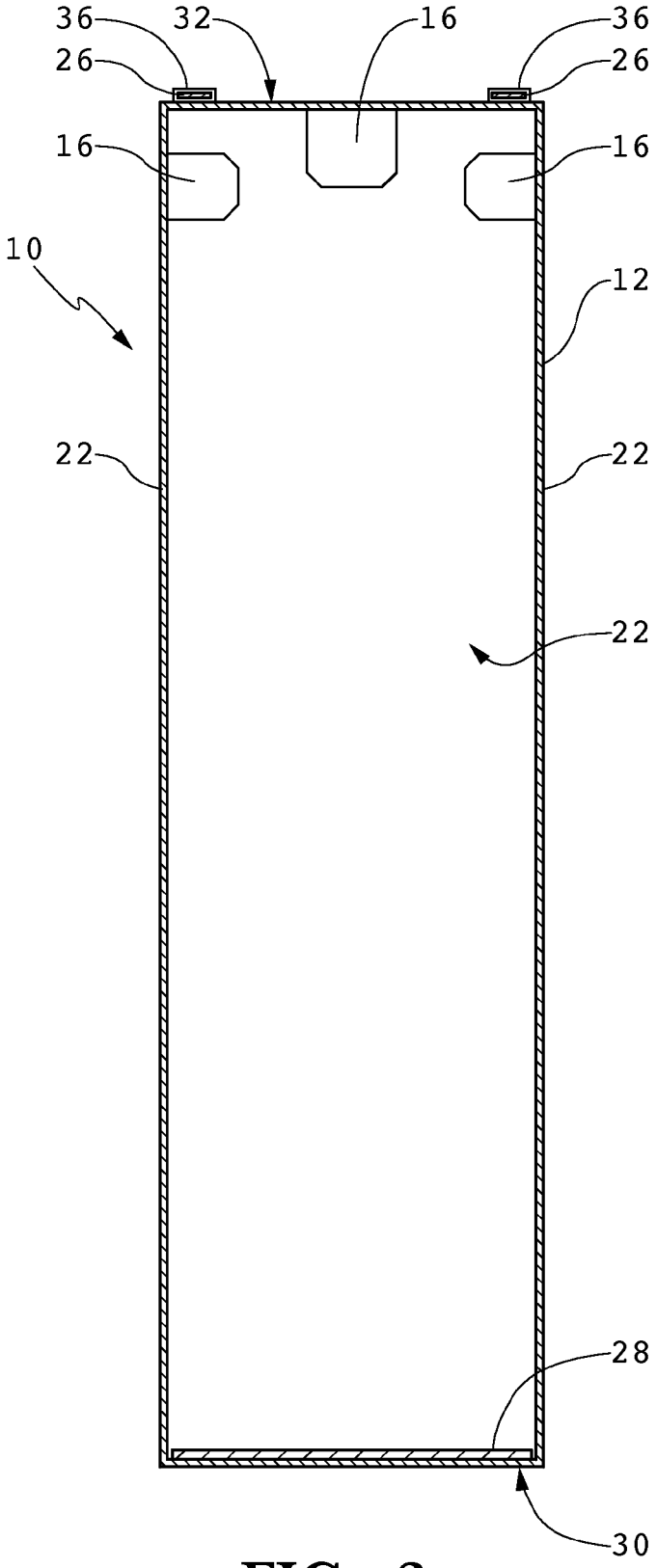
FIG. 3 is a cross-sectional view taken along the plane of 3-3-3 in FIG. 2 and illustrating an interior view of the embodiment illustrated in FIG. 2.

FIGS. 2 and 3 illustrate an exemplary embodiment of an enclosure liner, particularly a locker liner 10 configured to line an enclosure such as the locker 50 shown in FIG. 1. The liner 10 comprises a bag 12, which comprises a front panel 18, the front panel comprising an access 34. The bag 12 further comprises a top panel 32, first and second side panels 22, a back panel 20, and a bottom panel 30. The liner 10 further comprises a closure 14 about the access 34, generally along the front panel 18; hook pockets 16, generally attached to the top panel 32, the back panel 20, and the first and second side panels 22; and a pad 28. Although the bag 12 is designed to fit closely within the locker 50, as will be appreciated by one skilled in the relevant art, the liner 10 need not fit closely within the locker 50. The hook pockets 16 are formed to accommodate the locker hooks 54, and are aligned accordingly.

The bag 12 may be of any suitable material which inhibits the migration of dust and insect pests into the interior of the bag 12. The bag 12 may comprise flexible material to aid in conforming to the locker 50 and to facilitate insertion and removal of the liner 10 from the locker 50. The entire liner 10 is preferably breathable and washable. For strength and effectiveness, the bag 12 may comprise ripstop nylon.

For ease of viewing contents of the liner 10, all, or a portion of, the front panel 18 may comprise clear material. Good results have been achieved with clear vinyl. Alternatively, the front panel 18 may be opaque.

To seal the liner 10, while still allowing access to its contents, the front panel 18 comprises a re-sealable closure 14 to close the access 34. In an exemplary embodiment, a zipper is used. Other types may also be used which inhibit the migration of insect pests of interest or dust, for example. Examples might include hook-and-loop-type closures, such as Velcro® (Velcro USA, Manchester N.H.), and re-sealable adhesives suitably applied.

In addition to enabling the liner 10 to fit in a tailored fashion in the locker 50, the pockets 16 may be sized to allow clothing and other items to be hung on the hooks 54. This may be accomplished by enlarging the pockets 16.

The pad 28 is preferably rigid or semi-rigid to help support heavier objects such as shoes, for example, without distorting the shape of the liner 10. The contour of the pad 28 may be generally in the shape of the bottom panel 30.

To attach or otherwise secure the liner 10 in the locker 50, especially one constructed of metal, the liner 10 may comprise one or a plurality of magnets 26 secured within holders 36 which may be sewn onto or otherwise connected with the liner 10. Preferably, the holders 36 are sewn into the top panel 18.

Figure 4:
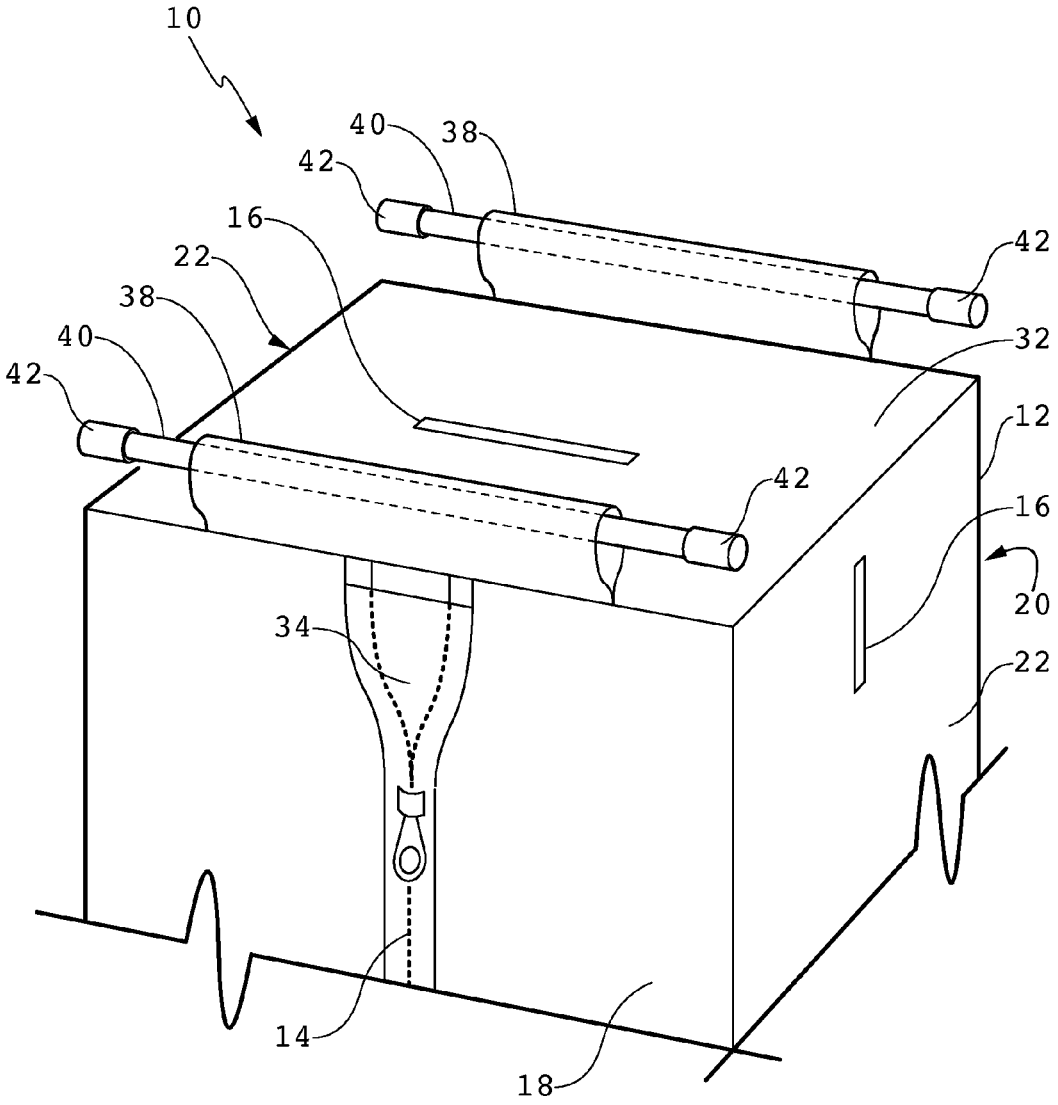
FIG. 4 is a perspective view of a top portion of an enclosure liner according to a further embodiment of the present invention.

Turning now to FIG. 4, an alternate embodiment of the liner 10 features a loop-and-rod configuration to attach the liner 10 in the locker 50, particularly when the locker 50 is non-metallic, such as one constructed with wood or plastic. A loop 38 is attached to the bag 12, preferably at or near the top panel 32. An elongated member, such as a wooden dowel rod or metal rod 40, extends through the loop 38 to about the width of the locker 50. A cap 42 may be attached to each end of the rod 40 to facilitate holding or suspending the liner 10 within the locker 50. In an exemplary embodiment, the caps 42 are formed from rubber or flexible plastic which is suitable to create a friction hold onto the sides 60 of the locker 50. In a further exemplary embodiment, the rod 40 is a two-piece telescoping bar which employs a spring to provide a compressive force to urge the ends of the rod 40 outward. In a further exemplary embodiment, the rod 40 is resilient and, when bent and placed into the locker 50, attempts to return to its straight shape and thereby urges each end into the sides 60 or the locker 50 to attach the liner 10 to the locker 50.

Figure 5:
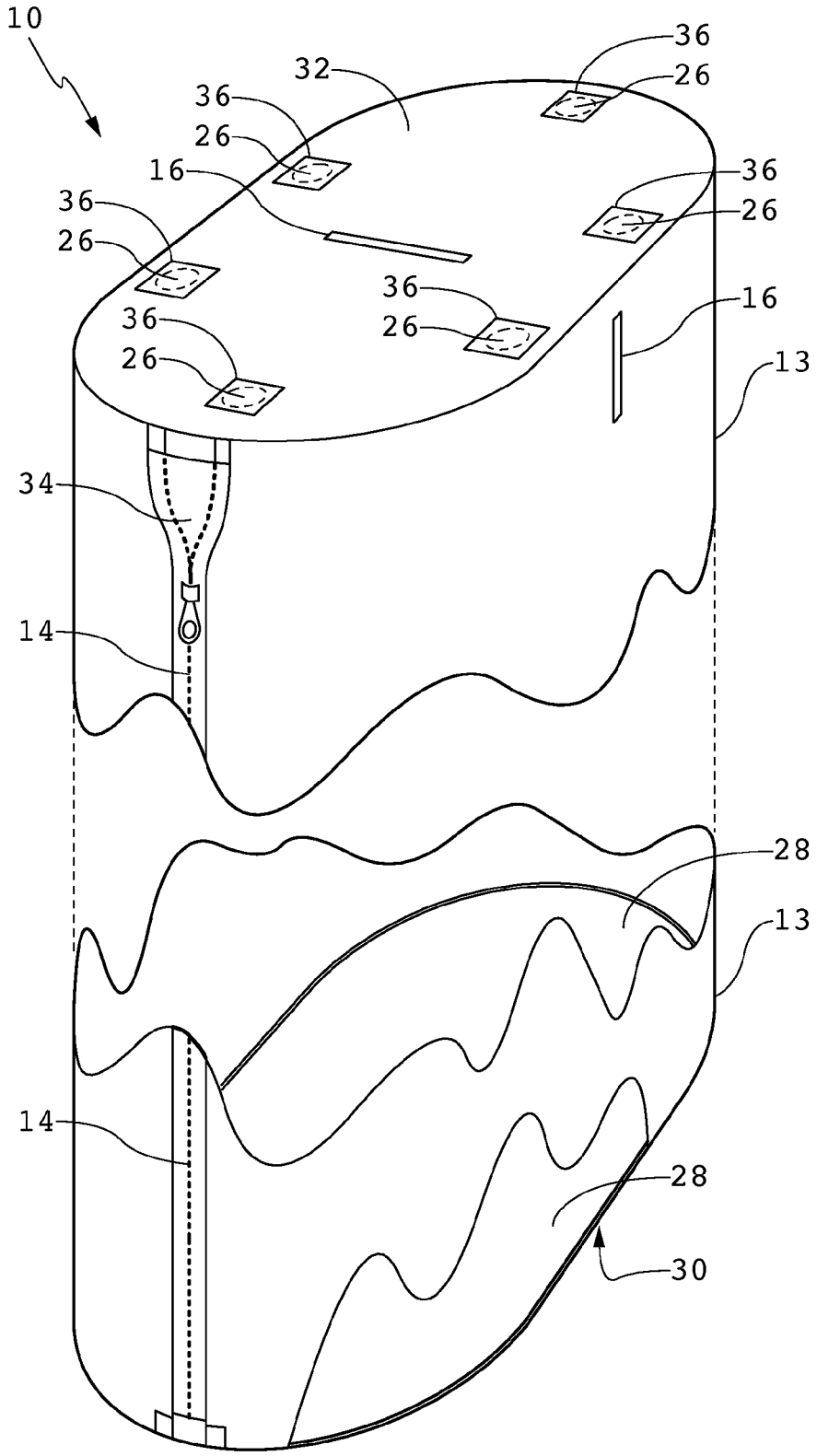
FIG. 5 is a perspective view of a top portion and a bottom portion of an enclosure liner according to a further embodiment of the present invention.

Turning now to FIG. 5, an alternate embodiment of the liner 10 includes a generally oval-shaped top panel 32. Such a modification may enable the liner 10 conform to an enclosure that is so shaped. And, as will be appreciated by those skilled in the relevant art, various shapes may be appropriate; round, for example. A bag 13 which includes the top panel 32 shown in FIG. 5 may not necessarily have identifiable front, side, and back panels, but will include pockets 16, attachment means such as magnets 26 secured in holders 14 attached to the top panel 32, an access 34, and a closure 14. Alternately, the loop-and-rod configuration may also be incorporated to attach the liner 10 to the locker 50.

While certain preferred embodiments of the present invention have been disclosed in detail, it is to be understood that various modifications may be adopted without departing from the spirit of the invention of scope of the following claims.

I claim:

1. A manufacture comprising:

a bag, the bag having an interior and an exterior, the bag formed to include an access to the interior, the bag comprising:

a top panel;

a bottom panel;

first and second side panels;

a back panel; and a front panel, the top panel, the bottom panel, the first and second side panels, the back panel, and the front panel mutually attached and cooperating to form the interior, the front panel including the access;

at least one socket the at least one socket configured to be extendable from the exterior into the interior, the pocket adapted to accommodate a locker hook;

a re-sealable closure, the closure attached to the periphery of the access, the closure effective to seal the access, thereby enclosing the interior; and attachment means secured to the bag, the attachment means suitable to suspend the bag inside an enclosure.

2. The manufacture of claim 1, wherein one of the at least one pockets is attached to the top panel, the top panel pocket extending into the interior.

3. The manufacture of claim 1, wherein on of the at least one pockets is attached to the first side panel, the first side panel pocket extending into the interior.

4. The manufacture of claim 1, wherein at least one of the top panel, bottom panel, first and second side panel, back panel, and front panel comprise ripstop nylon.

5. A manufacture, comprising:

a bag, the bag having an interior, the bag formed to include an access to the interior;

a re-sealable closure, the closure attached to the periphery of the access, the closure effective to seal the access, thereby enclosing the interior; and attachment means secured to the bag, the attachment means suitable to suspend the bag inside an enclosure, the attachment means comprising:

a plurality of loops, each loop adapted to accommodate an elongated member traversing therethrough; and a plurality of substantially straight telescopic members, each telescopic member comprising:

a first end and a second end, each telescopic member traversing through a respective loop; and a friction cap affixed to each first and second ends, each friction cap formed to create a friction hold onto sides of the enclosure.

6. A locker liner, comprising:

a bag, comprising:

a top panel;

a bottom panel, the bottom panel having an inside surface;

first and second side panels;

a back panel; and a front panel, the top panel, the bottom panel, the first and second side panels, the back panel, and the front panel mutually attached and cooperating to form a generally hexahedral interior, the front panel forming an access to the interior;

a zipper, the zipper attached to the periphery of the access, the zipper effective to seal the access, thereby enclosing the interior;

a plurality of pockets, the pockets attached to the top panel and the first and second side panels, the pockets configured to be extendable into the interior;

a plurality of magnets, the magnets enclosed in a like plurality of holders, the holders attached to the top panel; and a pad, the pad configured to rest on the inside surface of the bottom panel.

7. The locker liner of claim 6, wherein at least one of the top panel, bottom panel, first and second side panel, back panel, and front panel comprise ripstop nylon.

* * * * *